US010648473B2

(12) United States Patent
Fredrich et al.

(10) Patent No.: US 10,648,473 B2
(45) Date of Patent: May 12, 2020

(54) SCREW COMPRESSOR

(71) Applicant: GEA Refrigeration Germany GmbH, Berlin (DE)

(72) Inventors: Ole Fredrich, Berlin (DE); Ottomar Neuwirth, Berlin (DE); Stefan Losch, Berlin (DE)

(73) Assignee: GEA REFRIGERATION GERMANY GMBH (DE)

( * ) Notice: Subject to any disclaimer, the term of this patent is extended or adjusted under 35 U.S.C. 154(b) by 0 days.

(21) Appl. No.: 15/326,524

(22) PCT Filed: Jul. 10, 2015

(86) PCT No.: PCT/EP2015/001413
§ 371 (c)(1),
(2) Date: Jan. 16, 2017

(87) PCT Pub. No.: WO2016/012083
PCT Pub. Date: Jan. 28, 2016

(65) Prior Publication Data

US 2017/0211575 A1 Jul. 27, 2017

(30) Foreign Application Priority Data

Jul. 19, 2014 (DE) ..... 10 2014 010 534

(51) Int. Cl.
*F04B 49/22* (2006.01)
*F04C 28/24* (2006.01)
(Continued)

(52) U.S. Cl.
CPC ..... *F04C 29/126* (2013.01); *F04C 18/16* (2013.01); *F04C 29/0092* (2013.01); *F04C 2240/30* (2013.01)

(58) Field of Classification Search
CPC ..... F04C 14/06; F04C 14/26; F04C 29/126; F04C 18/16; F04C 29/0092; F04C 28/24; F04C 28/06; F04B 49/225
(Continued)

(56) References Cited

U.S. PATENT DOCUMENTS 3,941,505 A * 3/1976 Nasvytis ..... F04B 9/02 417/202
4,083,380 A * 4/1978 Huber ..... F16K 3/26 137/505.25
(Continued)

FOREIGN PATENT DOCUMENTS

DE 2 302 046 A 7/1974
DE 32 10 790 A1 10/1983
(Continued)

OTHER PUBLICATIONS

German Search Report dated May 18, 2015 in corresponding German Patent Application No. 10 2014 010 534.2.
(Continued)

*Primary Examiner* — Deming Wan
(74) *Attorney, Agent, or Firm* — Ostrolenk Faber LLP

(57) ABSTRACT

A screw compressor, in particular for refrigeration systems, comprising a compressor housing (1) which at least partly encloses the compressor, an integrated suction gas filter (2) and a non-return valve (7) that is to be actuated by pressurized gas; the compressor housing (1) has grooves, in particular drilled or cast ducts (13, 16 22, 23, 24) to which pressurized gas can be fed in order to control the non-return valve (7).

15 Claims, 3 Drawing Sheets

(51) Int. Cl.

| | |
|---|---|
| ***F04C 28/06*** | (2006.01) |
| ***F04C 29/12*** | (2006.01) |
| ***F04C 14/26*** | (2006.01) |
| ***F04C 14/06*** | (2006.01) |
| ***F04C 18/16*** | (2006.01) |
| ***F04C 29/00*** | (2006.01) |

(58) Field of Classification Search
USPC ... 418/201.2, 220, 185, 47, 201.1, 200, 202, 418/85, 97; 137/528, 535, 540, 542, 543
See application file for complete search history.

(56) References Cited

U.S. PATENT DOCUMENTS

| | | | | |
|---|---|---|---|---|
| 4,396,345 | A * | 8/1983 | Hutchinson | F04B 49/225 415/28 |
| 5,899,435 | A * | 5/1999 | Mitsch | F16K 25/00 251/282 |
| 7,273,068 | B2 * | 9/2007 | Ballenger | F02C 9/263 137/554 |
| 2005/0013702 | A1 | 1/2005 | Dieterich et al. | |
| 2006/0018769 | A1 * | 1/2006 | Van Praag | F04B 49/225 417/410.4 |
| 2008/0023081 | A1 * | 1/2008 | Huber | F04C 18/16 137/547 |
| 2009/0252627 | A1 | 10/2009 | Köck | |
| 2012/0328462 | A1 * | 12/2012 | Helgeson | F04C 2/126 418/1 |
| 2013/0136638 | A1 * | 5/2013 | Foerster | F04C 28/06 418/1 |
| 2016/0290521 | A1 | 10/2016 | Strotkoetter | |

FOREIGN PATENT DOCUMENTS

| | | | |
|---|---|---|---|
| DE | 34 00 545 | A1 | 7/1984 |
| DE | 103 33 400 | A1 | 2/2005 |
| DE | 10 2005 018 602 | A1 | 10/2006 |
| DE | 10 2006 016 317 | A1 | 10/2007 |
| DE | 10 2013 010 780 | A1 | 12/2014 |
| FR | 2 226 022 | A5 | 11/1974 |
| GB | 2 133 585 | A | 7/1984 |
| JP | H09-287580 | A | 11/1997 |
| WO | WO 2007/115789 | A1 | 10/2007 |
| WO | WO 2014/206576 | A1 | 12/2014 |

OTHER PUBLICATIONS

International Search Report dated Sep. 22, 2015 in corresponding PCT International Application No. PCT/EP2015/001413.
Written Opinion dated Sep. 22, 2015 in corresponding PCT International Application No. PCT/EP2015/001413.
Chinese Office Action dated Jun. 13, 2018 in corresponding Chinese Application No. 201580039012.8 and its English translation.

* cited by examiner

SCREW COMPRESSOR

CROSS-REFERENCE TO RELATED APPLICATIONS

The present application is a 35 U.S.C. §§ 371 national phase conversion of PCT/EP2015/001413, filed Jul. 10, 2015, which claims priority to German Patent Application No. 10 2014 010 534.2, filed Jul. 19, 2014, the contents of which are incorporated herein by reference. The PCT International Application was published in the German language.

TECHNICAL FIELD The present invention relates to a screw compressor.

BACKGROUND OF THE INVENTION

In plants comprising screw compressors, in particular in refrigerating plants, as shown, for example, in DE 10 2005 018 602 A1, non-return valves are usually disposed on the suction side of the compressors in order to prevent a rearward rotation of the compressor as a result of the pressure difference before and behind the compressor when the compressor drive is switched off, which rearward rotation could damage said compressor. Such non-return valves likewise serve to ensure that, when the compressor is at rest, the pressures of the plant before and behind the compressor do not equalize.

Such plants usually possess filters on the suction side of the compressors in order to prevent dirt from penetrating the compressor and damaging it.

In smaller and medium-sized compressors (up to about 800 $m^3/h$ suction volume), non-return valves integrated in the compressor housing, which are opened by the gas stream and closed by a compression spring, are customary. DE 10 2006 016 317 A1 shows an exemplary design which is actuated by a compression spring. In such compressors, suction gas filters integrated in the compressor housing are likewise customary.

Plants comprising larger compressors often have non-return valves and suction gas filters as separate components. The closure of the non-return valves is here advantageously realized not by a compression spring, but by gas which is under final pressure of the compressor, as described in patent application DE 10 2013 010 780.6. In order to provide the gas, plant components after the compressor are connected by pipelines, and a solenoid valve contained therein, to the non-return valve, which is disposed before the compressor. Valves of this construction have lower flow losses than valves having a compression spring.

Because of their large flow losses, the non-return valves which are usually used in small compressors and which are actuated by a compression spring are not advantageous. The flow-favorable non-return valves which are actuated by pressurized gas and which are customary in plants comprising larger compressors are expensive. The separately disposed components require a plurality of housings connected by connecting elements, which leads to high complexity of machining and assembly. Pipelines are necessary to conduct gas from the pressure side of the compressors to the non-return valve, the threaded joints of which pipelines are often, in practice, the cause of gas leaks.

SUMMARY OF THE INVENTION

Starting from the above, the object of the present invention is to define, in particular for smaller and medium-sized compressors, a design which in the region of the non-return valve has low flow losses. This design is to be made as cost-effective as possible and should have a least possible number of pipelines and threaded joints in order to minimize the risk of gas leaks. The installation of a suction gas filter should likewise be possible.

This object is achieved by a screw compressor having the features disclosed herein.

The object on which the invention is based is achieved by a screw compressor having the features disclosed herein. According to the invention, the non-return valve which, together with the suction gas filter, is present in the compressor housing is supplied with pressurized gas for the controlling of said valve, wherein the pressurized gas makes its way to the non-return valve through ducts bored or cast in the compressor housing. Present in the duct system is a solenoid valve, which is likewise disposed on the compressor and which serves to switch the pressurized gas supply on and off.

In a particularly compact possible embodiment of the invention, the suction gas filter is disposed coaxially around the non-return valve in such a way that the valve disk of the non-return valve moves within the suction gas filter. In this compact design, a cover of the compressor housing is simultaneously the end cover of the non-return valve, in which the valve rod is guided and enables the exchange of the filter.

This integrated solution is more cost-effective than the use of separate components in the plant. Through the relinquishment of external conduits, savings are made in terms of assembly costs and the risk of gas leaks as a result of broken conduits or leaky pipe couplings is avoided.

The non-return valve controlled by compression gas has lower flow losses than the non-return valves which are normally used in small and medium-sized screw compressors and are actuated by a compression spring.

BRIEF DESCRIPTION OF THE DRAWINGS

Further optional features of the invention are defined in the subclaims and in the following description of the figures. The described respective features can be realized individually or in any chosen combinations. The invention is hence described below with reference to the appended drawings on the basis of exemplary embodiments. In the drawings:

DESCRIPTION OF PREFERRED EMBODIMENTS

Figure 1:
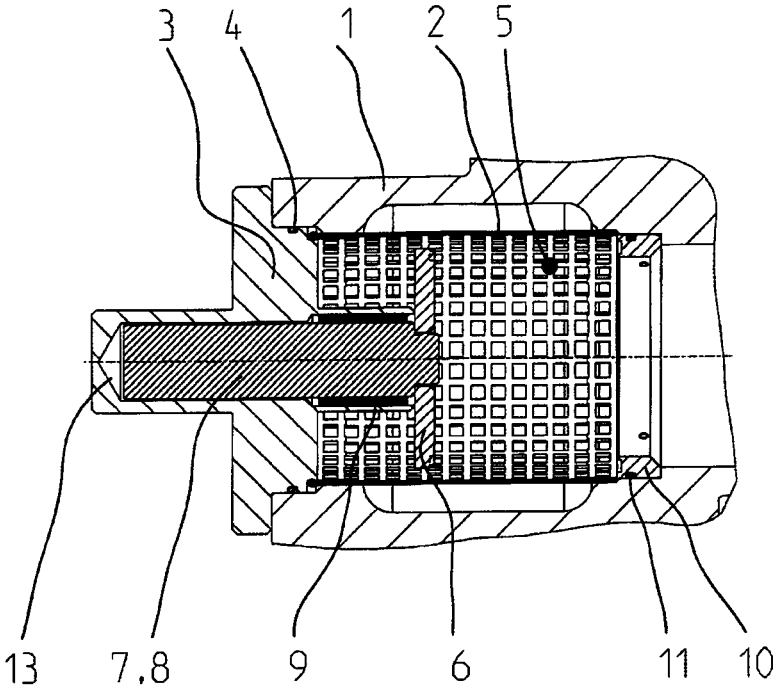
FIG. 1 shows a sectional representation of a non-return valve actuated by pressurized gas, in the open state, in combination with a filter which is a component part of a first embodiment of a screw compressor according to the invention.

In a first embodiment realized according to the invention, as is represented in FIG. 1, a suction gas filter 2, which has the shape of a cylinder that is open on both sides, is disposed in a compressor housing 1 of a screw compressor. The compressor housing 1 is closed off by a cover 3, so that a change or cleaning of the suction gas filter 2 is easily possible. The cover 3 is sealed off from the housing 1 by a first seal 4, for example an O-ring. At both ends, the suction gas filter 2 is fitted in the housing 1, so that the gas entering the compressor is forced to flow through a screen cloth 5 belonging to the suction gas filter 2, and not laterally past this.

Coaxially to the suction gas filter 2, a valve disk 6 of a non-return valve 7 is disposed on a valve rod 8. The valve rod 8 is guided by a linear ball bearing 9, so that valve disk 6 and valve rod 8 are jointly axially displaceable. The linear ball bearing 9 is disposed in a first duct 13 in the cover 3. The linear motion of the valve disk 6 is limited on one side by the stop against the cover 3, while in the other motional direction the valve disk 6 runs up against a valve seat 10 disposed in a bore in the compressor housing 1, which is likewise disposed coaxially to the valve disk 6 and suction gas filter 2. The valve seat 10 is sealed off by a second seal 11, for example an O-ring, against the compressor housing 1.

Figure 2:
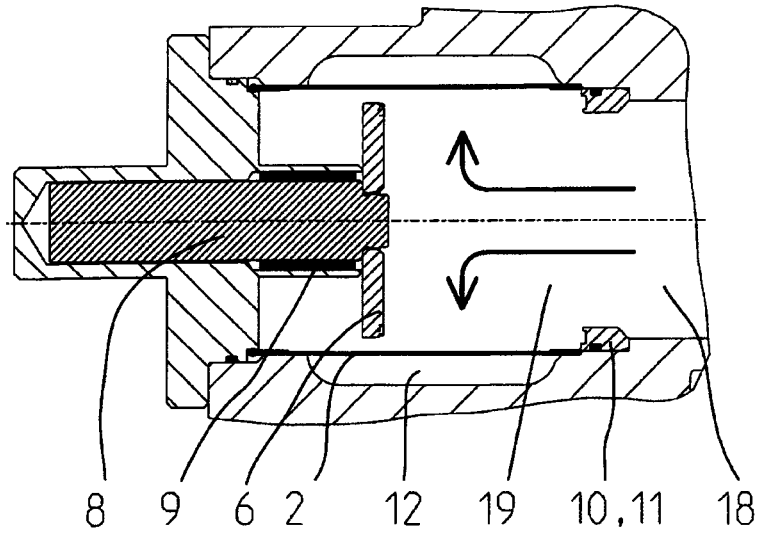
FIG. 2 shows the non-return valve of FIG. 1 in the open state (screw compressor in operation)

In a screw compressor in operation, the non-return valve 7, as represented as in FIG. 2, is open. The arrows show the flow of the gas sucked in by the screw compressor. This gas flows through a suction line 18 axially into a first gas space 19 between valve seat 10 and suction gas filter 2 and is deflected radially outward by the valve disk 6 and flows through the screen cloth 5 of the suction gas filter 2 into a second gas space 12, which is configured between the suction gas filter 2 and a screw rotor 14 of the compressor.

Figure 3:
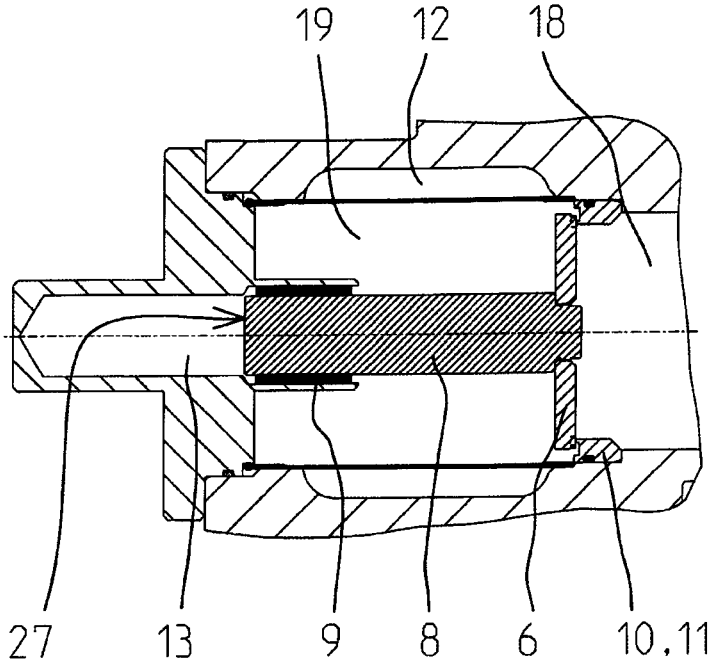
FIG. 3 shows the non-return valve of FIG. 1 in the closed state (screw compressor stopped)

In a screw compressor at rest, the non-return valve 7, as represented in FIG. 3, is closed. A possible pressure equalization of the different pressures of the working medium before and behind the screw compressor is thereby prevented. In order to close the non-return valve 7, pressurized gas from a third gas space 15, which (when a gas stream in the compressor is viewed during a normal operation of the compressor) is disposed downstream of the screw rotor 14, must impinge on the rear side 27 of the valve rod 8.

Figure 4:
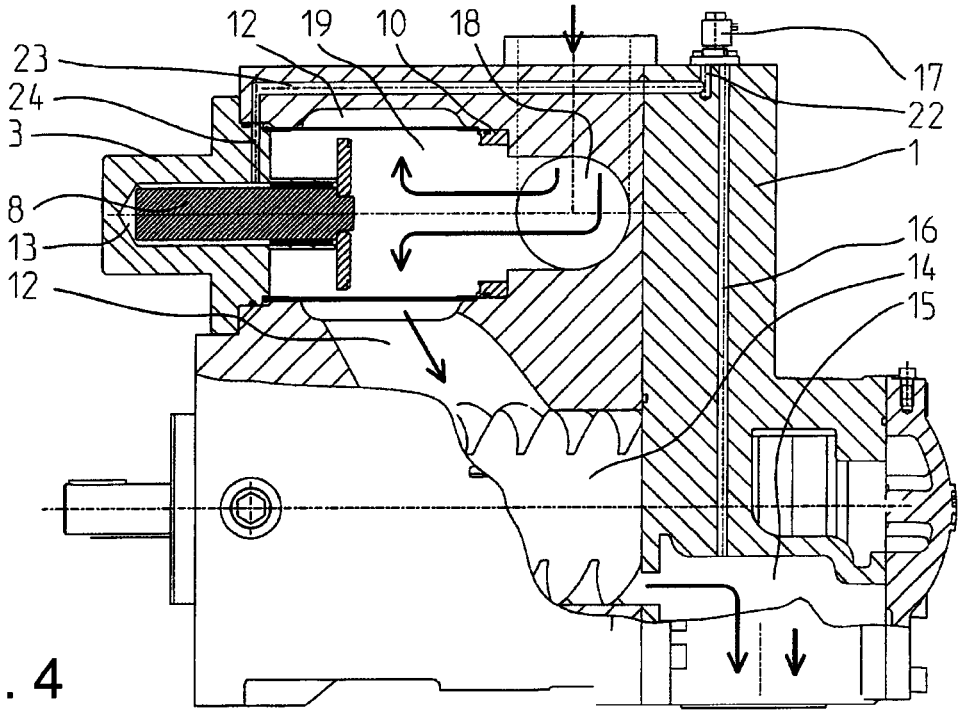
FIG. 4 shows a sectional representation of the first embodiment of a screw compressor, which shows a system of bores and solenoid valves through which gas under final pressure is conducted from a gas space behind the screw rotor to a duct for a rod of the non-return valve in the cover.

As shown in FIG. 4, a plurality of ducts and a solenoid valve 17 are therefore disposed in the compressor housing 1 and in the cover 3. From the third gas space 15, a second duct 16 runs to the solenoid valve 17, which is disposed directly on the compressor housing 1. From the solenoid valve 17, a third duct 22, a fourth duct 23 and a fifth duct 24, which are disposed directly in the compressor housing 1, lead into the cover 3 and there into the first duct 13.

When the screw compressor stops, the solenoid valve 17 opens, so that the non-return valve 7 closes. Once the solenoid valve 17 is opened, the pressurized gas makes it way out of the gas space 15 via the ducts 16, 22, 23 and 24 through the compressor housing 1 into the cover 3, and there into the first duct 13. In the first duct 13 is found the valve rod 8. The pressurized gas pushes the valve rod 8 with the valve disk 6 up to the valve seat 10. The valve is thus closed. A pressure equalization between the gas (pressurized gas or gas compressed by means of the screw rotor 14) in the suction line 18 and the gas in the third gas space 15 is thus prevented.

Following start-up of the screw compressor, the screw rotor 14 generates in the first and second gas space 12 and 19 between valve seat 10 and screw rotor 14 an underpressure which is lower than the pressure in the suction line 18, so that the non-return valve 7 opens and assumes the position shown in FIG. 2.

As long as the compressor is not started, the non-return valve 7 remains closed as a result of the pressure difference between the first gas space 19 and the suction line 18.

Figure 5:
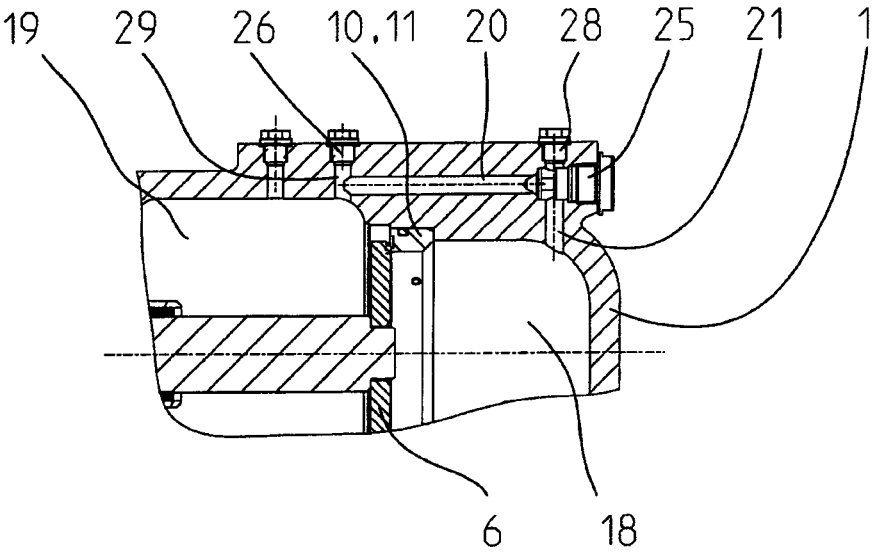
FIG. 5 shows a sectional representation of a detail of a second embodiment of a screw compressor according to the invention, which shows a system of bores and a shut-off valve, whereby a bypass can be created between the gas space before and behind the closed non-return valve. A position-indicating system, which can optionally be present in order to indicate the switch setting of the non-return valve, is represented schematically.

Since in maintenance works it can be necessary to create a pressure equalization between the first gas space 19 and the suction line 18, in a second possible embodiment of the plant according to the invention a system of bores and a shut-off valve, as shown in FIG. 5, is provided. As a result, a bypass can be created between the second gas space 12 and the suction line 18, which are separated by the valve disk 6 which bears against the valve seat 11.

A sixth duct 20 in the compressor housing 1 is connected by two ducts (seventh duct 21 and eighth duct 29) to the second gas space 12 and the suction line 18. At the junction of sixth duct 20 and seventh duct 21, a shut-off valve 25 is disposed in the compressor housing 1 such that, upon the closure of the shut-off valve 25, the connection from the sixth duct 20 to the seventh duct 21 is terminated or closed off. In maintenance works the shut-off valve 25 can be opened, so that the connection from sixth duct 20 to seventh duct 21 is opened and the pressure between the gas space 19, second gas space 12 and the suction line 18 can equalize.

In the presently described embodiment, to the cover 3 of the non-return valve 7 is attached a position-indicating system 30, by means of which an adjustment travel of the valve rod 8 can be registered. In individual embodiments, the registration can here be realized, for instance, on a mechanical, electrical or electromagnetic, and on a magnetic basis. In particular, an appropriate transmitter, which emits or transmits the adjustment travel, or a signal indicating or representing the adjustment travel, for instance an appropriate voltage signal, to a control apparatus, in particular a control apparatus of the compressor, can be provided.

In summary, it can be stated that in the above a screw compressor having, inter alia, the following features is described:

1. Screw compressor, in particular for refrigerating plants, which has a compressor housing 1 which at least partially houses the compressor, comprising an optional integrated suction gas filter 2 and an integrated non-return valve 7, wherein the non-return valve 7 is a valve to be actuated with pressurized gas and the compressor housing 1 possesses cavities, in particular bored or cast-in ducts 13, 16, 22, 23, 24, which can be subjected to pressurized gas for controlling of the non-return valve 7.

2. Screw compressor according to 1., wherein the screw compressor further has a valve 17, which is preferably realized as a solenoid valve, for switching on and off the pressurized gas supply to the non-return valve 7, wherein the solenoid valve 17 is disposed directly on the compressor housing 1 and creates the connection of the ducts 13, 16, 22, 23, 24 bored or cast in the compressor housing 1.

3. Screw compressor according to 1. or 2, wherein the non-return valve 7 has a valve disk 6 and the suction gas filter 2 is disposed coaxially around the non-return valve 7 in such a way that the valve disk 6 of the non-return valve 7 moves within the suction gas filter 2.

4. Screw compressor according to one of the preceding points (1., 2. or 3.), wherein the compressor housing 1 has a cover 3, and wherein the cover 3 of the compressor housing 1 is simultaneously the cover of the non-return valve 7.

5. Screw compressor according to one of the preceding points (1., 2., 3. or 4.), wherein the screw compressor has a third gas space 15, which is provided to receive compressed gas, i.e. pressurized gas, and a first duct 13, in which the non-return valve 7 is at least partially mounted, wherein the third gas space 15 and the first duct 13 are connected by means of a fluidic connection.

6. Screw compressor according to one of the preceding points (1., 2., 3., 4. or 5.), wherein the screw compressor has a/the third gas space 15, which is provided to receive compressed gas, i.e. pressurized gas, and a/the first duct 13, in which the non-return valve 7 is at least partially mounted, wherein the compressor housing 1 has a second duct 16, which at a first end opens out into the third gas space 15 and at a second end opens out into a first port of a/the solenoid valve 17, and wherein the compressor housing 1 has further ducts, in particular a third duct 22, a fourth duct 23 and a fifth duct 24, which are interconnected, wherein one of the ducts 22-24, at one of its end, opens out into a first port of a/the solenoid valve 17, and wherein another one of the ducts 22-24 opens out into a first duct 13.

7. Screw compressor according to one of the preceding points (1., 2., 3., 4., 5. or 6.), wherein the screw compressor has a suction volume, in particular a suction line 18 and a first gas space 19 which is disposed within the suction gas filter 2, wherein the first gas space 19 and the suction volume are connected by means of a fluidic connection.

8. Screw compressor according to one of the preceding points (1., 2., 3., 4., 5., 6. or 7.), wherein the screw compressor has a/the suction volume, in particular a/the suction line 18 and a/the gas space 19 which is disposed within the suction gas filter 2, and wherein the compressor housing 1 has ducts, in particular a sixth duct 20, a seventh duct 21 and an eighth duct 29, which are interconnected, wherein one of the ducts 20, 21, 29 opens out into the suction line 18, and wherein another of the ducts 20, 21, 29 opens out into the second gas space 12.

9. Screw compressor according to one of the preceding points (1., 2., 3., 4., 5., 6., 7. or 8.), wherein the non-return valve 7 has a valve rod 8, which is guided by means of a linear ball bearing 9, in particular in a first duct 13 of the compressor housing 1.

10. Screw compressor according to one of the preceding points (1., 2., 3., 4., 5., 6., 7., 8. or 9.), wherein on the cover 3 of the non-return valve 7 is disposed, in particular attached, a position-indicating system 30, for registering the adjustment travel of the valve rod 8.

Although the invention is described on the basis of embodiments having fixed feature combinations, it also, however, embraces the conceivable further advantageous combinations, as are defined in particular, but not exhaustively, by the subclaims. All features disclosed in the application documents are claimed as fundamental to the invention, insofar as they, individually or in combination, are novel in relation to the prior art.

REFERENCE SYMBOL LIST

1 compressor housing
2 suction gas filter
3 cover
4 seal
5 screen cloth
6 valve disk
7 non-return valve
8 valve rod
9 linear ball bearing
10 valve seat
11 seal
12 gas space
13 duct
14 screw rotor
15 gas space
16 duct
17 solenoid valve
18 suction line
19 gas space
20 duct
21 duct
22 duct
23 duct
24 duct
25 shut-off valve
26 locking screw
27 rear side of the valve rod 8
28 locking screw
29 duct
30 position-indicating system

The invention claimed is:

1. A screw compressor, in particular for refrigerating plants, which has a compressor housing which at least partially houses the compressor and is sealingly closed with a removable cover, comprising an integrated non-return valve in the suction line of the compressor, a valve being integrated into the housing of the compressor, wherein the removable cover includes a duct that receives a valve rod connected to the non-return valve, the non-return valve is a valve actuated with pressurized gas from an open state to a closed state to close the suction line, the pressurized gas being supplied to the duct in which the valve rod is received, and the compressor housing possesses a supply duct that includes a plurality of ducts defined in the compressor housing to supply the pressurized gas to the duct in which the valve rod is received, the supply duct receiving the pressurized gas for the actuation of the non-return valve from the open state to the closed state, wherein the valve is moved from a closed state to an open state by gas from the suction line, and wherein the valve rod is not biased with a spring.

2. The screw compressor as claimed in claim 1, wherein the screw compressor further has another solenoid valve, for switching on and off the pressurized gas supply to the non-return valve, wherein the solenoid valve is disposed directly on the compressor housing and creates the connection of the cavities in the compressor housing.

3. The screw compressor as claimed in claim 1, wherein the compressor housing has a cover, and in that the cover of the compressor housing is simultaneously the cover of the non-return valve.

4. The screw compressor as claimed in claim 1, wherein the screw compressor has a third gas space, which is provided to receive compressed gas, and a first duct, in which the non-return valve is at least partially mounted, wherein the third gas space and the first duct are connected by means of a fluidic connection.

5. The screw compressor as claimed in claim 1, wherein the screw compressor has a third gas space, which is provided to receive compressed gas, and a first duct, in which the non-return valve is at least partially mounted, wherein the compressor housing has a second duct, which at a first end of the second duct opens out into the third gas space and at a second end of the second duct opens out into a first port of a solenoid valve, and wherein the compressor housing has a third duct, a fourth duct and a fifth duct, which are interconnected, wherein one of the ducts, at one of its ends, opens out into a first port of the solenoid valve, and wherein another of the ducts opens out into the first duct.

6. The screw compressor as claimed in claim 5, wherein the screw compressor has a suction volume, in particular the suction line and a first gas space, and the compressor housing further includes a sixth duct, a seventh duct and an eighth duct, which are interconnected, wherein one of the ducts opens out into the suction line, and wherein another of the ducts opens out into a second gas space.

7. The screw compressor as claimed in claim 6, wherein the first gas space is disposed within an integrated suction gas filter.

8. The screw compressor as claimed in claim 1, wherein the non-return valve has the valve rod, which is guided by means of a linear ball bearing, in particular in a first duct of the compressor housing.

9. The screw compressor as claimed in claim 8, further comprising a position sensor on the cover of the non-return valve that registers a position indicative of the adjustment travel of the valve rod.

10. The screw compressor as claimed in claim 1, wherein the cavities are ducts bored or cast-in.

11. The screw compressor as claimed in claim 1, wherein the another valve is a solenoid valve.

12. The screw compressor as claimed in claim 1, wherein the screw compressor further comprises an integrated suction gas filter.

13. The screw compressor as claimed in claim 12, wherein the non-return valve has a valve disk and the suction gas filter is disposed coaxially around the non-return valve in such a way that the valve disk of the non-return valve moves within the suction gas filter.

14. The screw compressor as claimed in claim 12, wherein the screw compressor has a suction volume, in particular the suction line and a first gas space which is disposed within the suction gas filter, wherein the first gas space and the suction volume are connected by means of a fluidic connection.

15. The screw compressor as claimed in claim 14, wherein the first gas space is disposed within an integrated suction gas filter.

* * * * *